US005996685A

United States Patent [19]

Alizadeh

[11] Patent Number: 5,996,685

[45] Date of Patent: Dec. 7, 1999

[54] AXIAL FLOW FAN

[75] Inventor: Ahmad Alizadeh, Indianapolis, Ind.

[73] Assignee: Valeo Thermique Moteur, Le Mesnil St. Denis, France

[21] Appl. No.: 08/511,035

[22] Filed: Aug. 3, 1995

[51] Int. Cl.[6] ..... F28F 13/00

[52] U.S. Cl. ..... 165/121; 165/122; 123/41.49; 180/68.1; 416/169 A; 416/189; 416/192

[58] Field of Search ..... 165/122, 121, 165/51, 41; 123/41.49; 180/68.1; 416/169 A, 189, 192

[56] References Cited

U.S. PATENT DOCUMENTS

| | | | |
|---|---|---|---|
| 4,181,172 | 1/1980 | Longhouse | 165/121 X |
| 4,358,245 | 11/1982 | Gray | 165/121 X |
| 4,505,641 | 3/1985 | Tsuchikawa et al. | 416/169 A X |
| 4,548,548 | 10/1985 | Gray, III | 416/189 |
| 4,569,631 | 2/1986 | Gray, III | 416/169 A X |
| 4,684,324 | 8/1987 | Perosino | 416/189 |
| 4,685,513 | 8/1987 | Longhouse et al. | 416/192 X |
| 4,930,984 | 6/1990 | Kesel et al. | 416/189 X |
| 5,242,013 | 9/1993 | Couëtoux et al. | 165/121 |
| 5,244,347 | 9/1993 | Gallivan et al. | 416/169 A X |
| 5,326,225 | 7/1994 | Gallivan et al. | 416/169 A X |
| 5,393,199 | 2/1995 | Alizadeh | 416/169 A X |
| 5,489,186 | 2/1996 | Yapp et al. | 416/189 X |

*Primary Examiner*—Christopher Atkinson
*Attorney, Agent, or Firm*—Morgan & Finnegan, L.L.P.

[57] ABSTRACT

An axial flow fan has a hub with a longitudinal axis of rotation and an outer periphery for the hub. Several blades are secured at their root regions to the hub's outer periphery. Each of the blades has a medial line that is tangential to a respective hub radius at the hub's outer periphery.

5 Claims, 20 Drawing Sheets

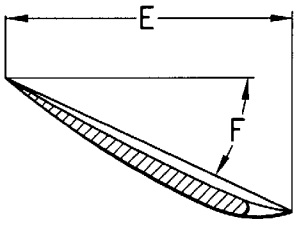
FIG.7(III)
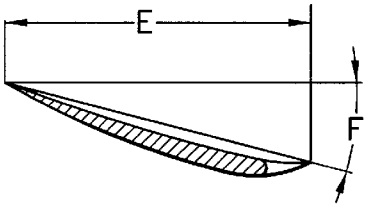
FIG.7(VII)
FIG.7(VIII)

AXIAL FLOW FAN

FIELD OF THE INVENTION

The present invention relates to an axial flow fan of the type usable in vehicle cooling systems and more specifically to such a fan which incorporates an integral air guide, and the like.

BACKGROUND OF THE INVENTION

To pass cooling air through a heat exchanger, such as a vehicle radiator, an axial flow fan is often used. The fan may be disposed upstream of the heat exchanger, such that air is blown through the heat exchanger, or downstream, such that air is drawn through the heat exchanger by the fan. Where air is blown through the heat exchanger by the fan, the air pressure in the region between the fan and the heat exchanger is raised by the action of the fan, and on the side of the fan remote from the heat exchanger, the air pressure is lowered. The reverse situation applies where air is drawn by the fan. There is accordingly a tendency for air to flow directly around the axial periphery of the fan between the high pressure region and the low pressure region. This air circulation, called reflux of air and causing so-called "tip vortices", however does not provide any cooling benefits.

Recently much interest has centered around the provision of a so-called "shroud" extending axially from the fan to at least a portion of the heat exchanger. The shroud is stationary and has a portion which houses the circumferential periphery of the fan. One function of such a shroud is to funnel air from the heat exchanger to the fan; another is to reduce the area of any reflux path around the fan. A problem in some applications is that the shroud increases the complexity of, and also adds to the weight of the cooling arrangement. Furthermore the acoustic properties of a shroud may cause resonances to occur and this is undesirable.

It is also known to provide axial flow fans with a so-called "tip support ring", in the form of a rotating cylindrical band disposed at, and joining together, the tips of the plural blades of the fan. The tip support ring provides additional stiffness to the fan and accordingly provides more predictable fan properties and dimensions. The ring may be used in cooperation with the stationary shroud to provide further restriction of the area for reflux flow around the fan.

SUMMARY OF THE INVENTION

According to a first aspect of the present invention there is provided an axial flow fan having plural blades secured at their root regions to a hub portion for rotation therewith about a longitudinal axis, and at their tip regions to a member for rotation therewith, the member having a blade tip support portion, the blade tips being secured to the blade tip support portion, and an air guide portion disposed concentrically about the axis beyond the axial extent of the blades, and being contiguous with the blade tip support portion, the air guide portion defining a fan opening lying in a plane perpendicular to the fan axis.

Preferably the blade tip support portion has a first constant radius and the fan opening has a radius greater than the first radius.

Alternatively the blade tip support portion has a first constant radius and the fan opening has a radius smaller than first radius.

Preferably the air guide portion has a truncated cone shape.

Conveniently there are provided a prime number of fan blades.

Advantageously the chord length of each blade is substantially constant from root to tip.

Alternatively the chord length of each blade may vary from root to tip, the variation being less than 10% of the minimum chord length.

Preferably the medial line of each blade is tangential to the fan radius at the root.

Advantageously the blade chord angle decreases along the span of the blade from root to tip.

According to a second aspect of the present invention there is provided an axial flow fan according to the first aspect, wherein the hub portion supports the rotor of a brushless electric motor, in combination with the stator of the motor wherein the stator has a shaft portion on which the hub portion is rotatably borne.

Advantageously the combination further comprises electronic commutating circuitry, whereby the motor is a brushless d.c. motor.

Conveniently the commutating circuitry is secured to the stator.

Alternatively the commutating circuitry is provided on a circuit member for mounting remote from the stator.

According to a third aspect of the present invention there is provided a combination of an axial flow fan according to the first aspect of the invention with a heat exchanger having a planar face portion for cooperation with said fan opening and an electric motor having a shaft connected to the fan hub for driving the fan, the electric motor being secured to the planar face portion of the heat exchanger.

Advantageously there is provided a motor back plate for securing to the planar face portion, the back plate having two circular ribs concentric with the motor shaft and extending beside the motor to define therebetween an annular slot and the fan hub portion has a circular-cylindrical periphery which extends into said annular slot to define a serpentine path into the interior of the hub portion whereby access of water to the motor is inhibited.

Conveniently the hub portion has an internal axially-projecting circular rib portion radially aligned with the radially inner ribs of the motor back plate for restricting the ingress of water.

BRIEF DESCRIPTION OF THE DRAWINGS

An embodiment of the invention will now be described, by way of example only, with reference to the accompanying drawings in which.

In the figures like reference numerals indicate like parts.

DESCRIPTION OF THE PREFERRED EMBODIMENTS

Figure 1:
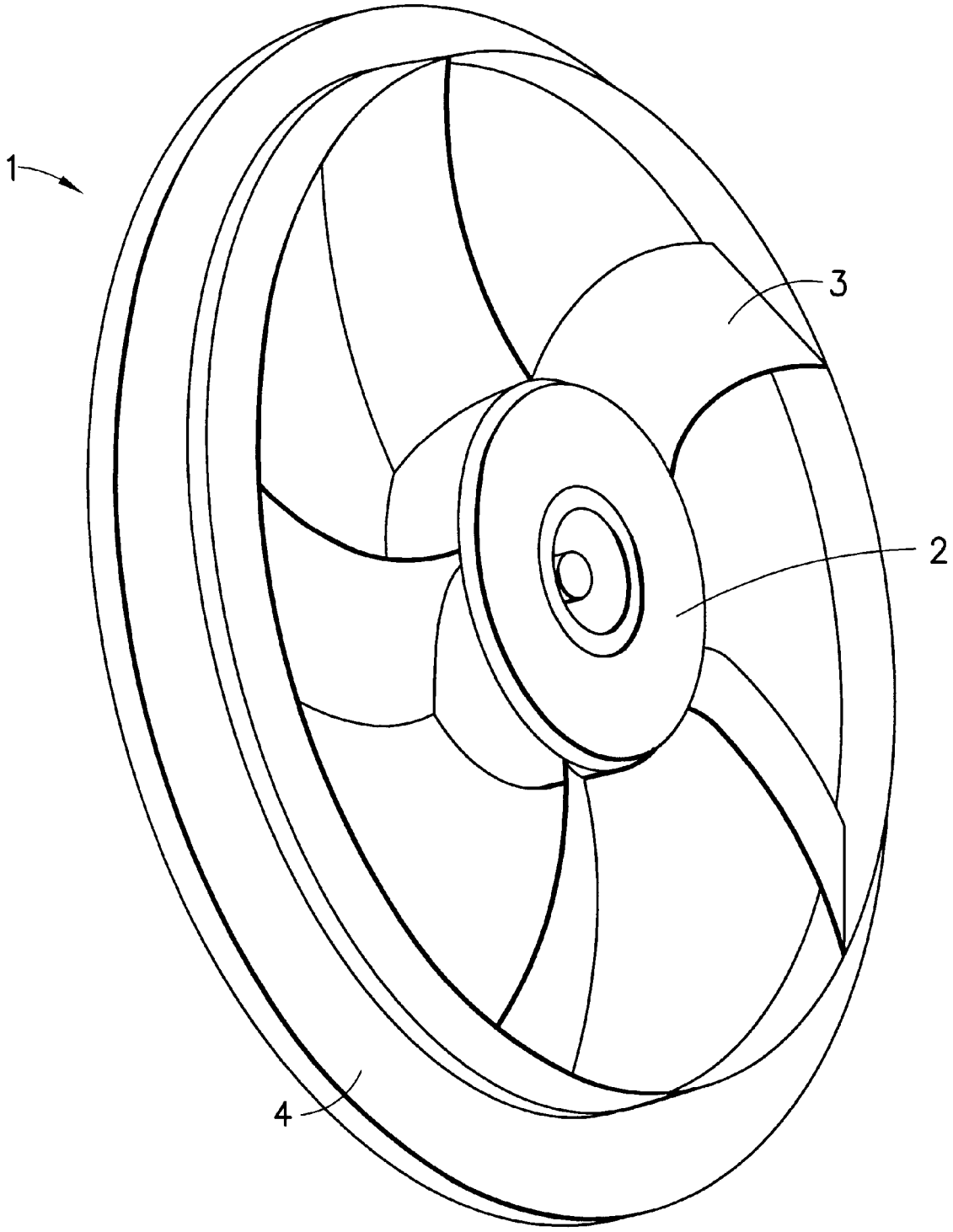
FIG. 1 shows a perspective view of an embodiment of the fan in accordance with the present invention.
Figure 2:
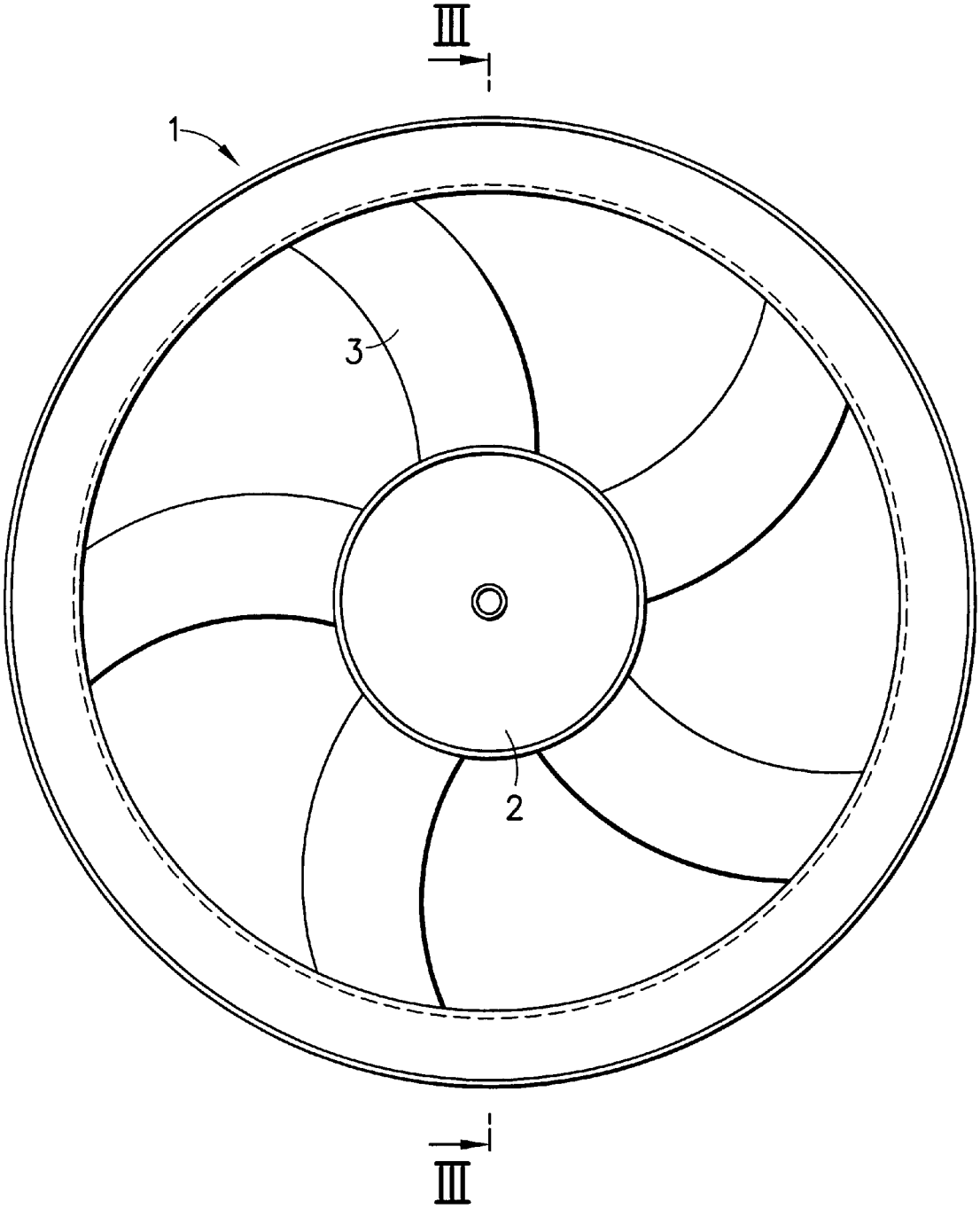
FIG. 2 shows a front elevation of the fan of FIG. 1.
Figure 3:
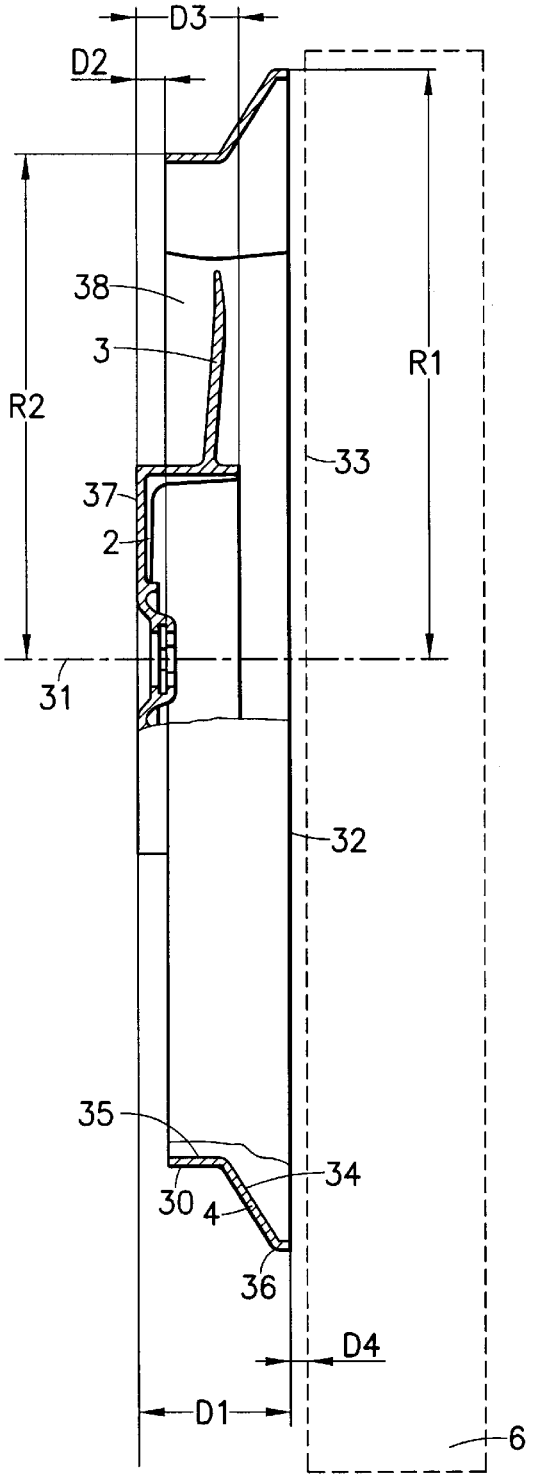
FIG. 3 shows a partial cross-section through the fan of FIG. 2 along the lines III–III'.

Referring firstly to FIGS. 1 to 3, the fan (1) of the first embodiment has a central hub portion (2) supporting plural, in the present embodiment 5, blades (3). The tip region of the blades (3) is secured to a circular member (4) which rotates with the fan. The rotating circular member (4) has a first portion which extends circumferentially about the blade tips (3), and a second contiguous portion which extends axially of the fan and, in use, towards an associated heat exchanger. The member (4) has two main functions, namely that of a blade tip ring, i.e. providing support for the blades (3) and that of a shroud, i.e. restricting the flow of air between the high and low pressure sides of the fan and constraining air to flow through the associated heat exchanger (6).

As best seen in FIG. 3, the rotating circular member (4) has a rear cylindrical wall portion (36) defining a rear opening (32) of a first radius R1 for disposition adjacent to a planar face portion (33) of the heat exchanger (6). The rear opening (32) lies in a plane perpendicular to the fan axis. In this description, the adjective 'rear' signifies fan-axially nearer to the heater exchanger, and 'front' signifies fan-axially further from the heat exchanger. Like adjectives and adverbs are to be construed accordingly. The radially-inner wall of the circular member tapers radially inwardly and forwardly from the opening (32) along a transition wall portion (34), which is terminated by a front cylindrical wall portion (35) defining a front opening (38), having a second radius R2 less than the radius of the rear opening (32). The front cylindrical wall portion extends parallel to the axis (31) of the fan away from the heat exchanger face portion (33). It is desirable that the rotating circular member has a low inertia. Consequently the wall thickness is kept small and the outer periphery of the rotating circular member (4) closely conforms to the above-recited shape of the radially inner wall. Low inertia is desirable to reduce the torque required of the motor used to rotate the fan and circular member with respect to the heat exchanger.

The front cylindrical wall portion (35) corresponds to the blade tip ring and the transition wall portion (34) provides some of the effects of a shroud.

Taken from a front face (37) of the hub portion (2), the first rear opening (32) is axially rearwardly spaced by a first distance (D1), the front edge of the cylindrical wall portion (35) is axially rearwardly spaced by a second distance (D2) and the rear edge of the hub portion (2) by a third distance (D3). The first distance (D1) is greater than the third distance (D3) which is in turn greater than the second distance (D2). The rearmost extremity of the wall portion (36) is spaced from the underlying heat exchanger face portion (33) by a fourth distance (D4). This fourth distance is sufficient to prevent contact between fan and heat exchanger while being small enough to reduce noise and prevent tip vortices.

Figure 4:
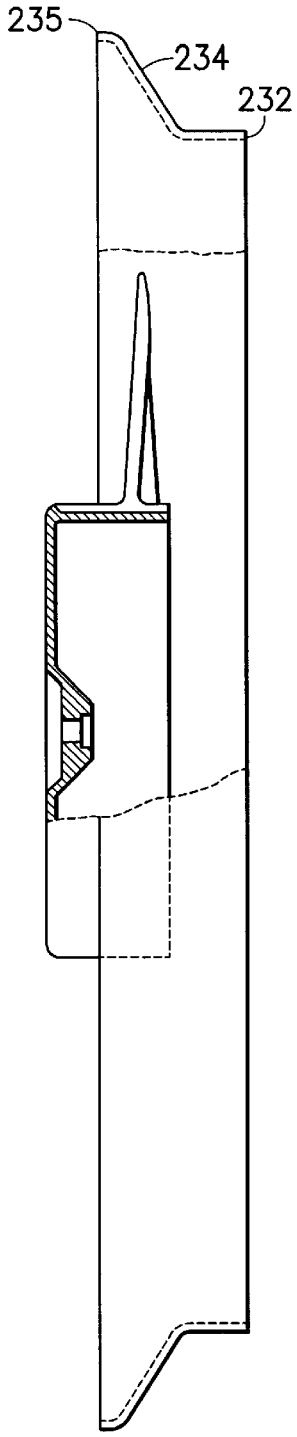
FIG. 4 shows a view corresponding to FIG. 3 of an alternative embodiment of a fan in accordance with the present invention.

Although in the embodiment of FIG. 3 the transition wall portion (34) tapers down from the rear opening (32), other arrangements are possible. For example, in FIG. 4 an embodiment of the fan has a transition wall portion (234) tapering outwardly from a rear opening (232) to a forward opening (235). It will be understood that, according to the particular application for which the fan is to be used, yet further possibilities occur. In particular, the tip ring-support portion may itself be non-cylindrical, for example may have a desired taper.

The fan of this embodiment has a hub portion of generally cylindrical form, having planar front face (37) and a cylindrical side wall. Internal ribs may provide air circulation within the hub to cool an associated electric motor. An alternative hub structure is described later herein with respect to FIG. 21.

Figure 5:
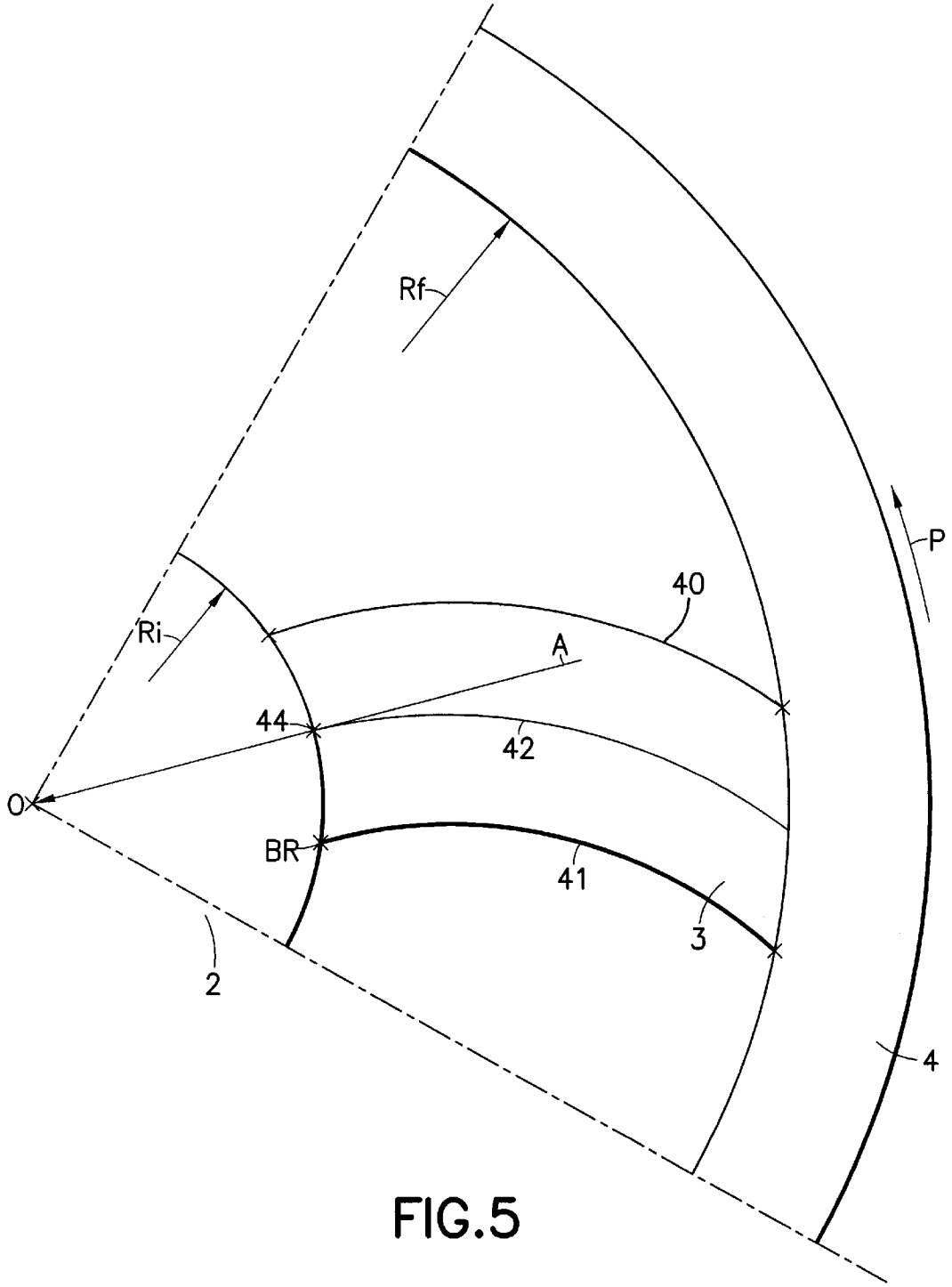
FIG. 5 shows a projection of one of the blades of the fan of FIG. 1 onto a plane perpendicular to the axis of rotation of the fan.

Referring now to FIG. 5, the shape of one of the blades (3) of the fan will now be described.

The blade (3) has a leading edge (40), a trailing edge (41) and a medial line (42). As will be seen from FIG. 5, in the embodiment described all of the leading edge, trailing edge and medial line are skewed rearwardly with respect to the direction of rotation P. In other words, the intersection of the tip of the leading edge, the trailing edge and the medial line with the rotating circular member (4) are behind, in the direction of rotation, the corresponding intersections at the root portion, with the hub member (2). This is however a feature of the embodiment being described, and other arrangements are possible depending on the field of use. Specifically the fan blades could be radial, i.e. unskewed, or could be forwardly skewed. A forwardly skewed fan is described later herein with reference to FIGS. 19–21. As will be later described with reference to FIGS. 6 and 7, in the presently described embodiment, the chord length of each blade is substantially constant along the length of the blade. Depending on features of the field of use, such as the blade loading, variations in chord length may be desirable.

Returning to FIG. 5, point O indicates the fan origin, or axis. Line OA represents the radius of the fan passing through the point of intersection (44) of the medial line (42) with the outer periphery of the hub portion (2). The radius OA is tangential to the medial line (42) at the intersection point (44). The blade (3) is effectively built outwardly from the medial line so that the curve of the leading edge is matched by the curve of the trailing edge, in the same sense.

Figure 6:
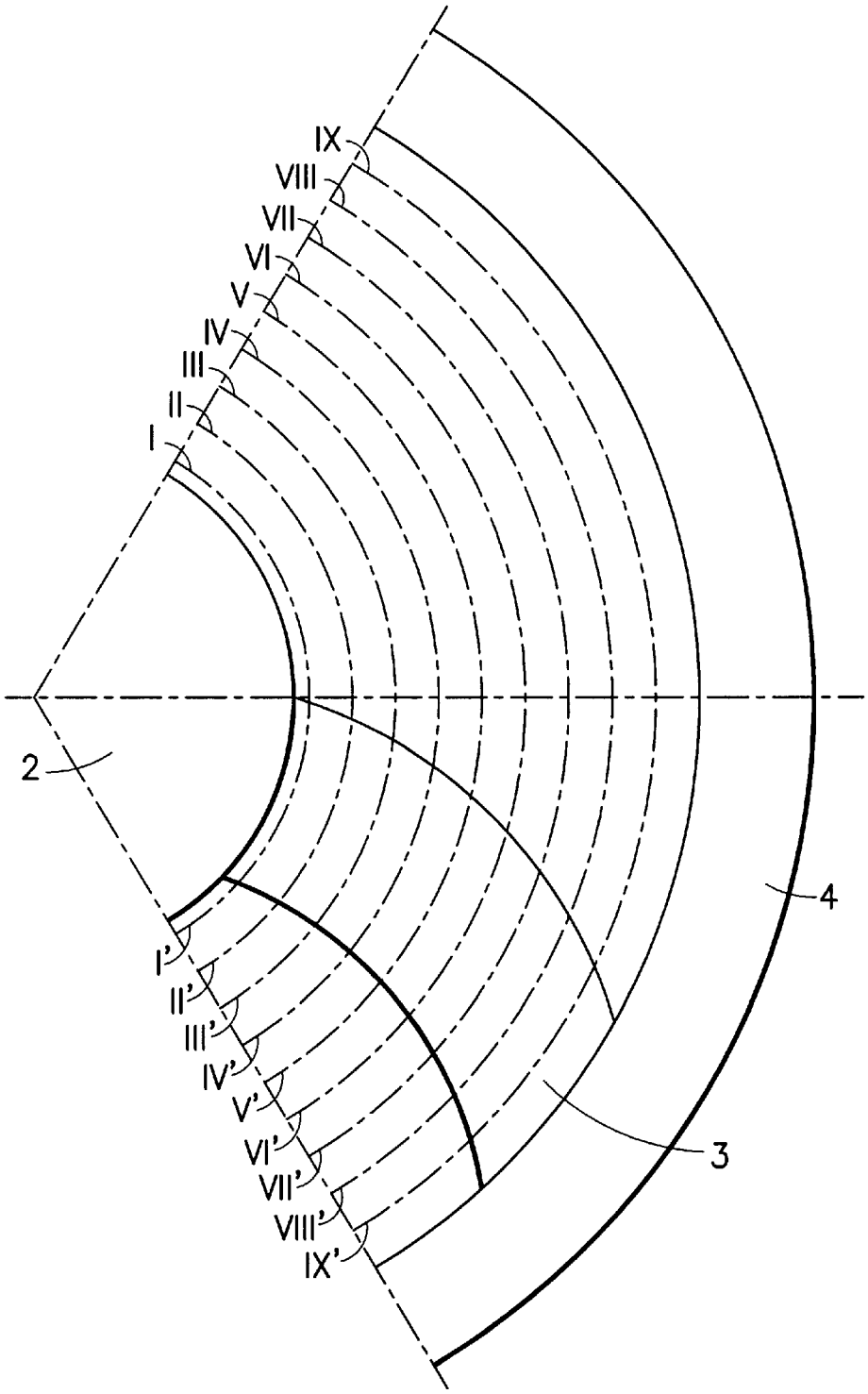
FIG. 6 is a view of the blade of FIG. 5, showing radially separated section lines I–I' to IX–IX'.
Figure 7I:
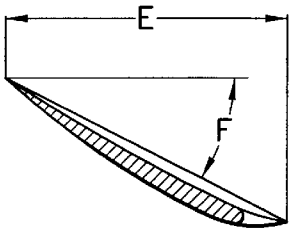
FIGS. 7(*i*)–7(*ix*) shows a number of radial cross-sections through the blade of FIGS. 5 and 6.
Figure 7:
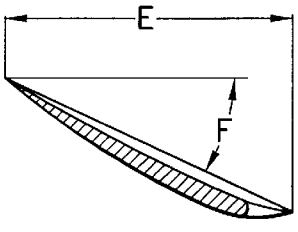
Figure 7:
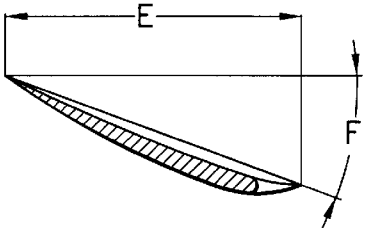
Figure 7V:
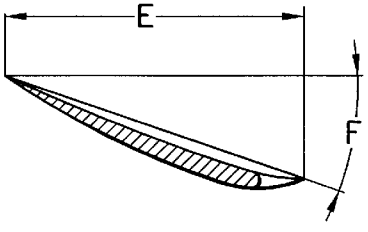
Figure 7:
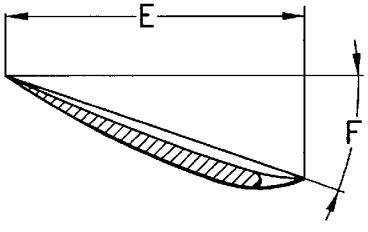
Figure 7:
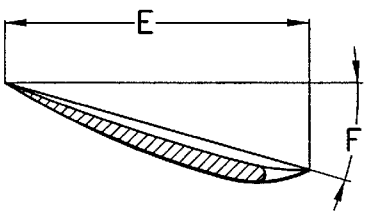
Figure 7:
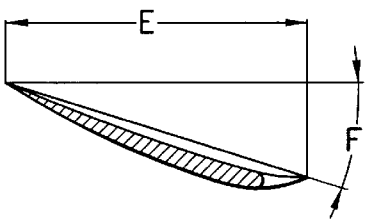

FIG. 6 shows the disposition of equally radially-spaced section lines I–I' to IX–IX' through the blade (3) of FIG. 5. FIGS. 7(*i*) to 7(*ix*) show sections along the circumferential lines of FIG. 6. FIG. 7(*i*) is in the root region of the blade and successive figures show sections taken at successive radial distances outwardly along the blade. Inspection of the figures shows that the length of the line E which represents the projection of the blade chord length onto the plane perpendicular to the axis of rotation of the fan, remains substantially constant along the span of the blade. Alternatively, the length of the line E could vary by up to 10% of the minimum length of line E. Inspection of FIGS. 7(*i*)–(*ix*) also shows that the pitch angle F of the blade reduces along the blade span. The rate of variation is higher towards the blade root portion than towards the tip portion.

As previously discussed, the fan is disposed adjacent to a planar face portion of a heat exchanger and is of particular, but not exclusive utility in a vehicle application. The fan may be driven by an electric motor which is conveniently secured to the planar face portion of the heat exchanger in such a fashion that the opening (32) of the rotating shroud or circular members (4) is in close proximity to the planar face portion. Where the heat exchanger is part of a vehicle, the heat exchanger may be a condenser or a vehicle radiator. In either case securing the motor to the heat exchanger portion may present problems due to rain, road spray or the like which may pass through the core of the heat exchanger and which might affect the operation of the motor.

Figure 8:
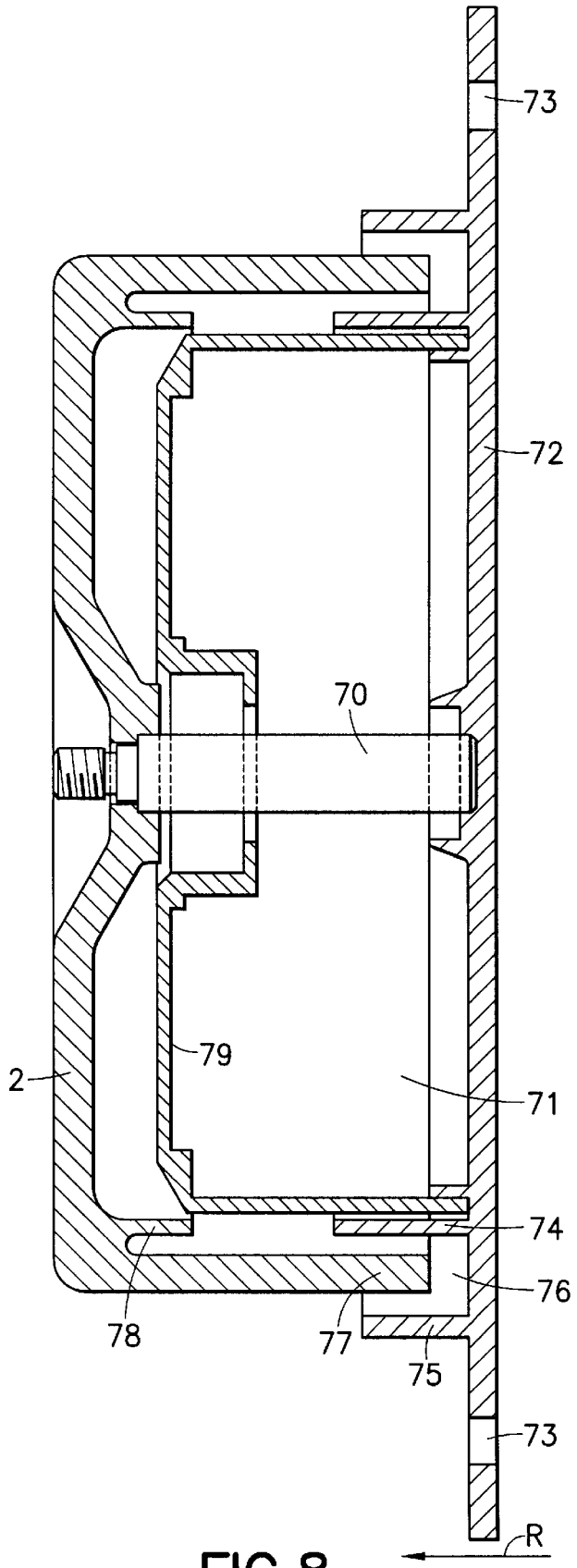
FIG. 8 shows a partial cross-section through the hub of the fan of FIG. 1 and the relationship with a motor back plate.

FIG. 8 shows an attachment for a motor and a modified form of hub for reducing the effects of water.

Referring then to FIG. 8, the hub (2) is shown secured to a shaft (70) of an electric motor (71). Arrangements for securing the hub to the motor shaft will be described later herein with reference to FIGS. 9–12. The motor (71) is secured by means (not shown) to a back plate (72) which has fixing holes (73) to enable the backplate, motor and fan to be secured to the planar face portion of the heat exchanger, typically a motor vehicle radiator. The motor back plate member (72) has an external periphery which is primarily determined by the position of the fixing holes (73) and corresponding attachment holes in the radiator. The back plate (72) has, on the side remote from the radiator, two rib portions (74,75) which project forwardly perpendicular to the face of the plate (72) and which extend around respective circular paths coaxial with the motor shaft (70). As shown, the cross section of ribs (74,75) is rectangular; however other cross sections may be used. The ribs (74,75) define between them an annular axially forward-facing slot (76), and this is adapted to receive the axially-rearward peripheral portion (77) of the hub portion (2). As will be seen from FIG. 8, the axial extent of one rib (75) is less than that of the other (74). The effect of housing the peripheral portion (77) of the fan hub portion (2) in the slot (76) is to shield the motor (71) from the ingress of water. Typically water will pass rearwardly through the heat exchanger in the direction shown by the arrow R. Thus, the serpentine path presented by the interaction of the two ribs (74,75) and the extremity or peripheral portion (77) of the hub portion (2) tend to inhibit the access of water to the motor. In a modification, the hub portion (2) may further be provided with a rearwardly-projecting rib portion (78) which is generally aligned with rib (74) of the back plate (72). Rib (78) of the hub portion (2) projects rearwardly towards the back plate rib (74) to have a rear most extremity behind the exposed face (79) of the motor (71). This rearwardly-projecting rib (78) thus deflects any water which does pass through the serpentine path described above to be deflected away from the motor (71).

Alternatively, it would be possible to seal the motor (71) to prevent ingress of water. However, this is not a preferred option, as the motor is adjacent to the heat exchanger, and is thus subject to substantial temperature variations which may make sealing undesirable. The arrangement described above with respect to FIG. 8 has the advantage of allowing cooling air to reach the motor and also allows for expansion and contraction of air immediately surrounding the motor and for a degree of thermal isolation between the hub portion and the motor back plate (72).

Different arrangements for securing the fan hub to the motor shaft (70) will now be described with respect to FIGS. 9–12.

Figure 9:
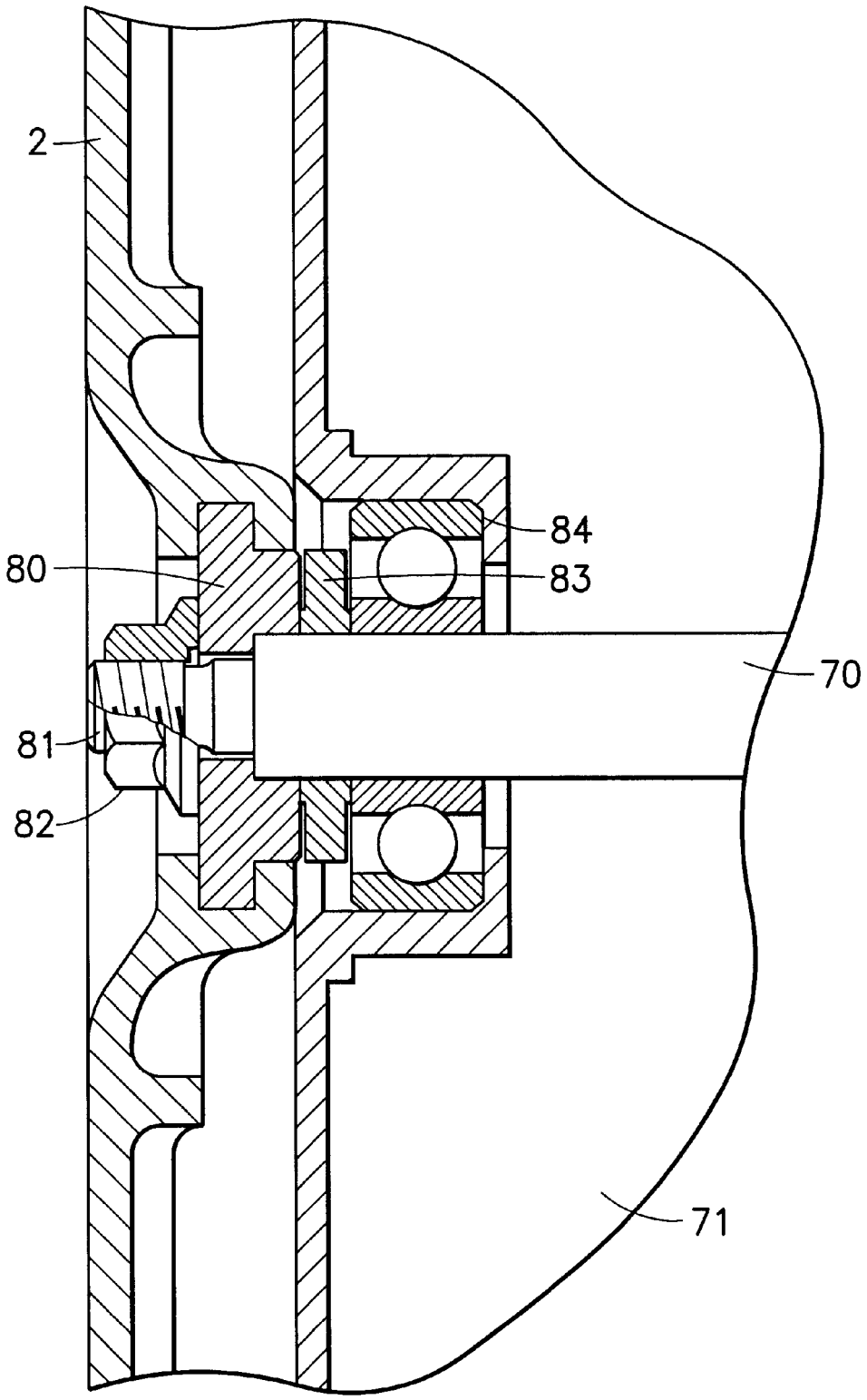
FIGS. 9–12 show alternative arrangements securing the fan hub to a motor shaft.

Referring first to FIG. 9, the hub portion (2), which is preferably molded from plastics material contains a hub insert member (80) which is preferably of metal, and which is molded into the hub portion (2) to allow the hub portion to be secured to shaft (70). The insert has a through-hole for a projecting portion of the shaft (70) and conveniently has one or more internal flats to provide non rotary engagement with a corresponding number of flats on the shaft. As will be seen from FIG. 9, the shaft has a threaded end portion (81). Once the hub has been placed on the shaft (70) and each flat portion of the shaft aligned with the corresponding flats on the insert, a nut (82) is attached to the threaded portion (81) and tightened. In the arrangement of FIG. 9, a spacer washer (83) is provided between the motor-side axial extremity of the insert (80) and an end bearing (84) of the motor (71).

Figure 10:
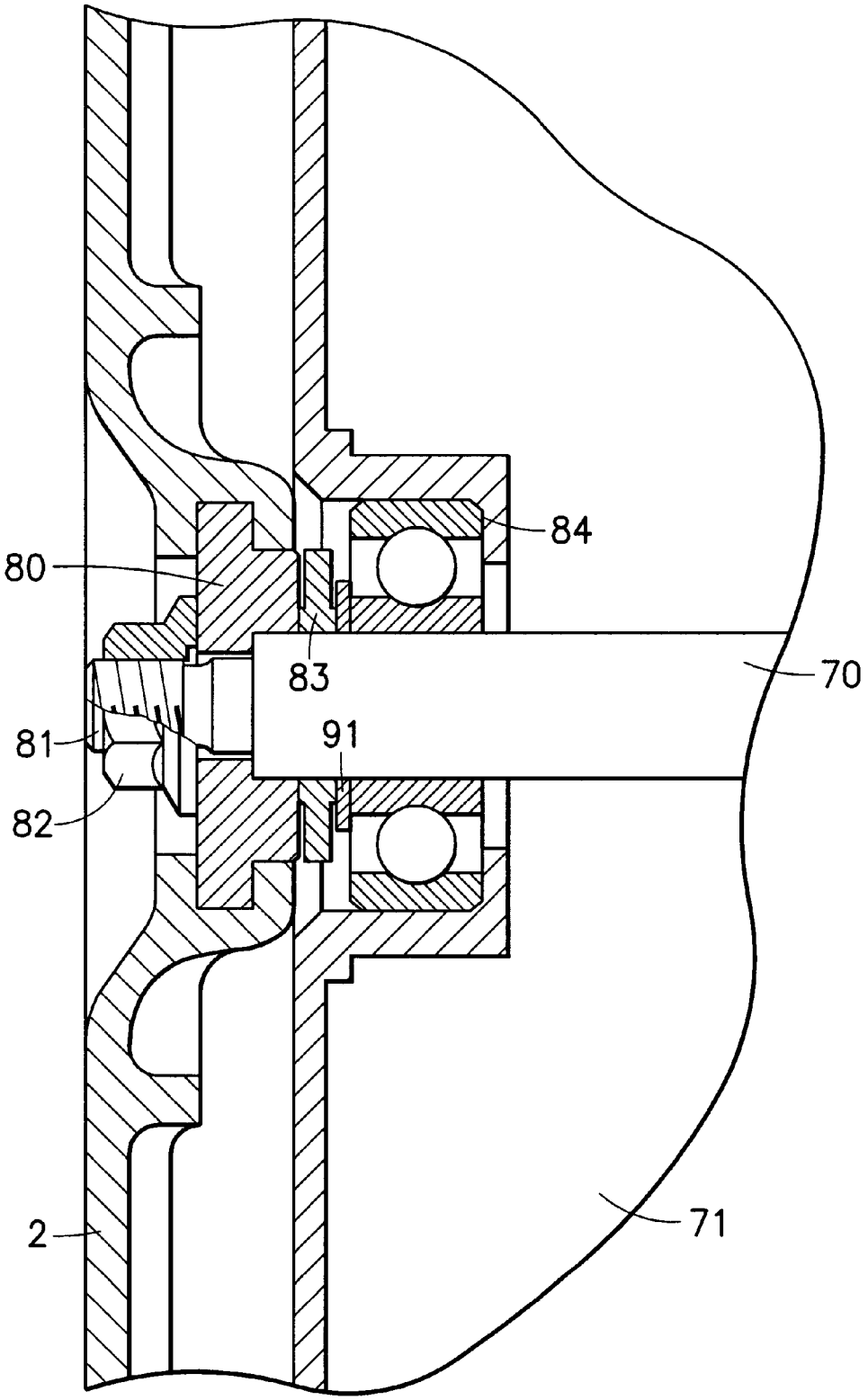

Referring to FIG. 10, a similar arrangement to that of FIG. 9 is shown but in this case, a bearing-retaining circlip (91) is disposed between the washer (83) and the bearing (84).

Figure 11:
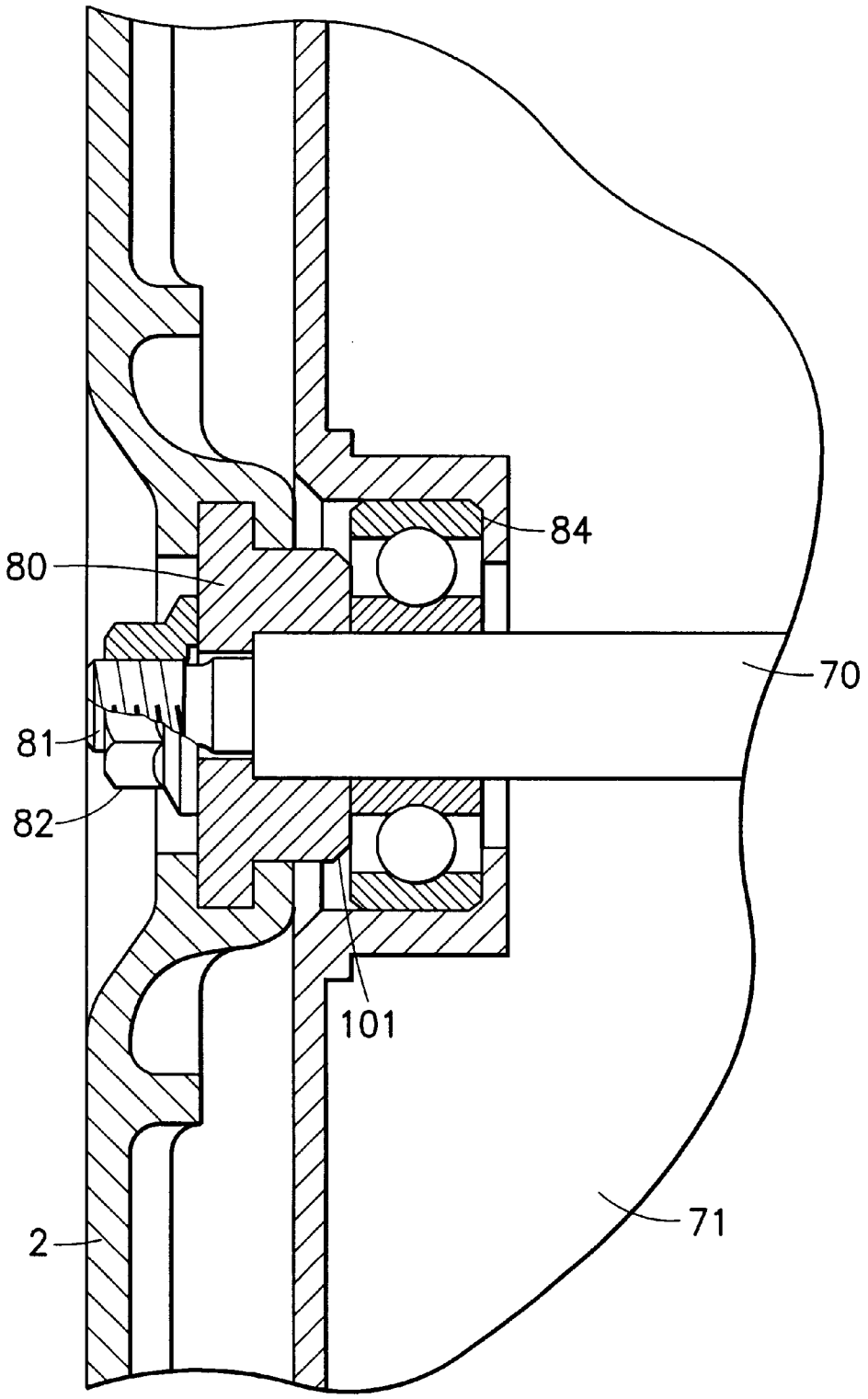

Referring to FIG. 11, yet another arrangement avoids the need for a washer (83), by providing the insert (80) with a motor-side taper portion such that the radial extent of the axially rearward portion of insert (80) corresponds to the extent of the inner ring of bearing (84). Since the inner ring of bearing (84) rotates with the shaft (70) no additional friction is caused by the presence of insert (80).

Figure 12:
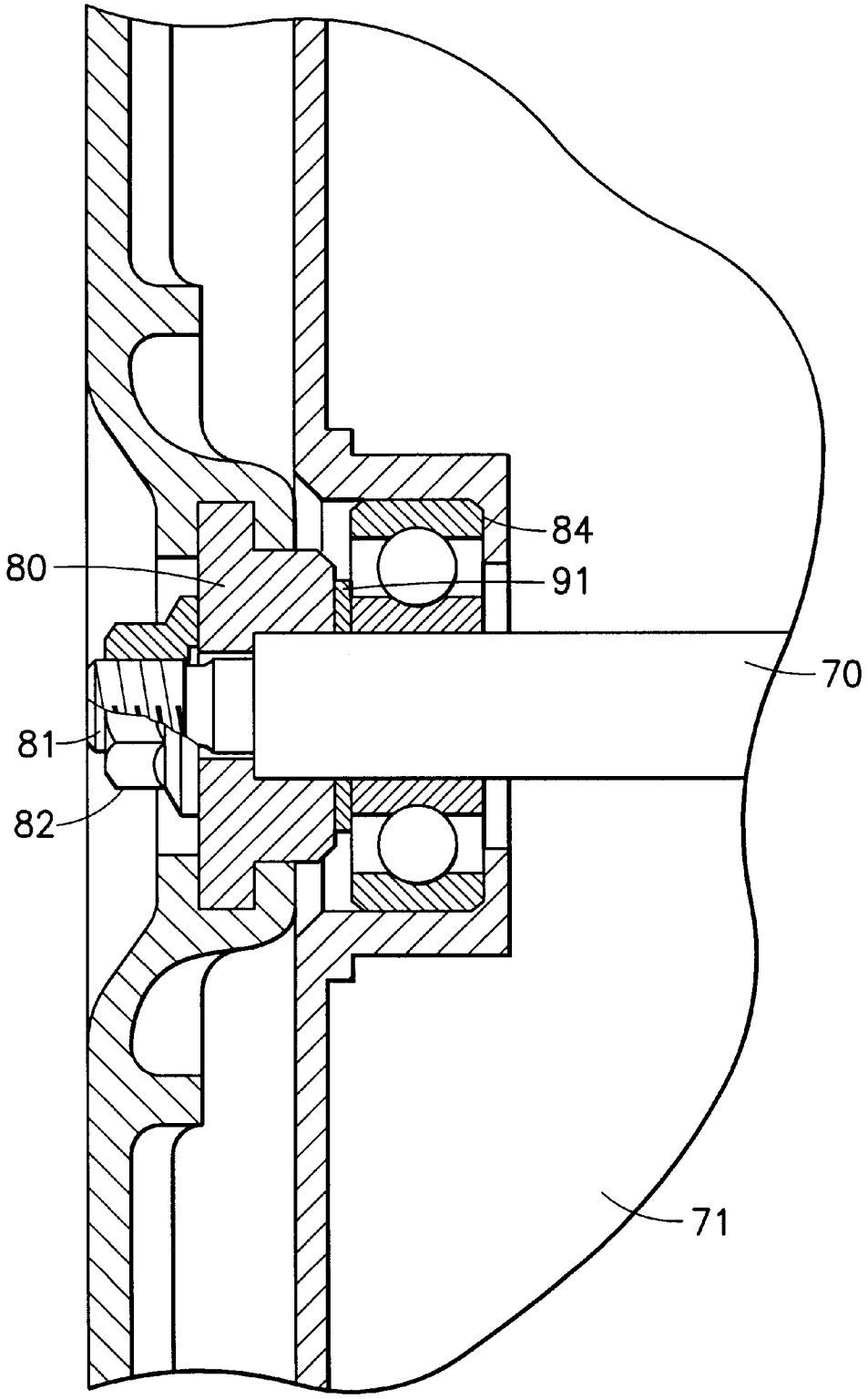

Turning to FIG. 12, a modification of the arrangement of FIG. 11 is shown, in which the insert (80) has a tapered portion similar to that described with respect to FIG. 11, but a circlip (91) is disposed between the axially-rearmost portion of the insert, and the inner ring of bearing (84).

The embodiment described with respect to FIG. 9 is particularly applicable where a separate electric motor is used to rotate the fan. However, other electric driving arrangements are possible. Specifically, it may be desirable to use the hub (2) as a part of the motor, rather than providing a separate motor.

Figure 13:
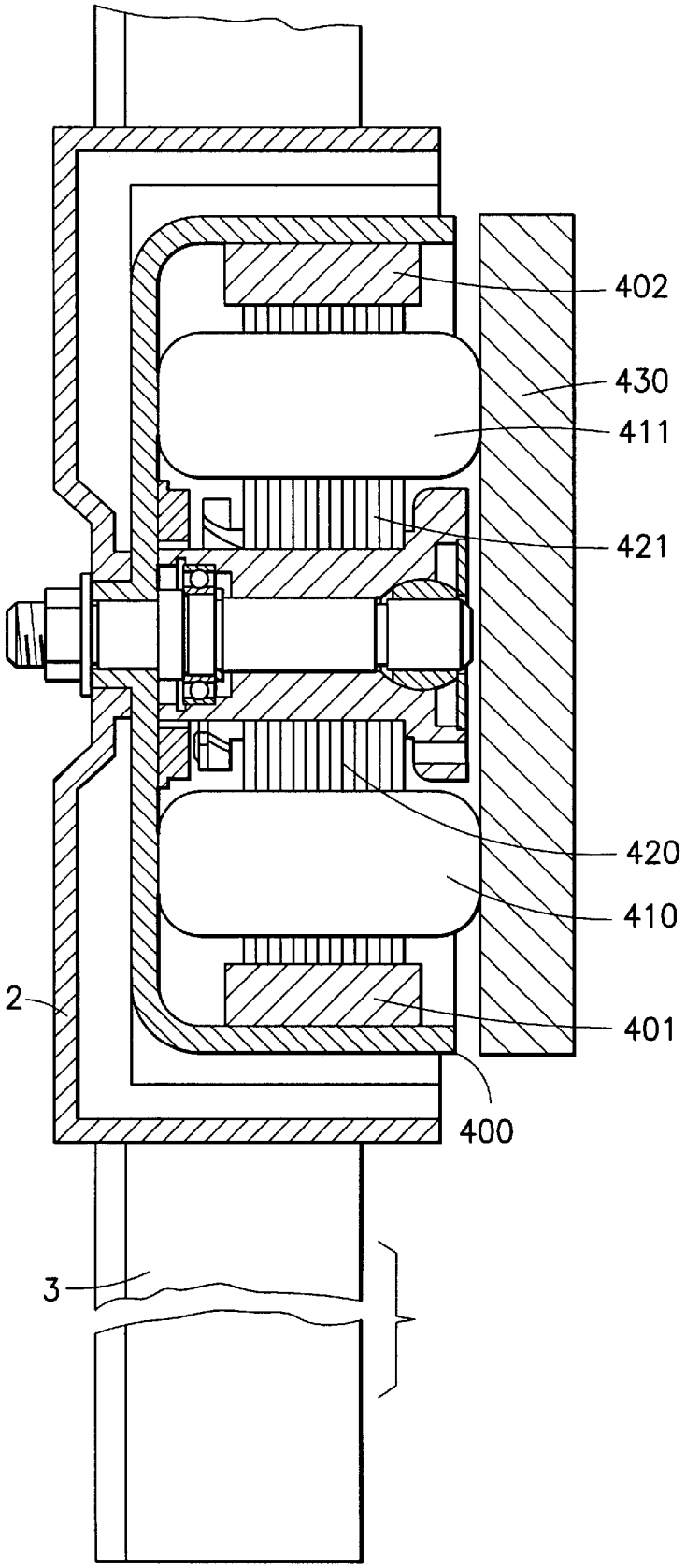
FIG. 13 shows an axial cross-section through a fan of the invention showing an integral electric motor.

In some applications an alternating current supply may be available to operate the fan. In this case the hub may form the rotor part of an induction motor, cooperating with an internally-disposed stator. However, where the invention is used in a vehicle application, normally only direct current is available. In this event, the hub (2) may form or carry the rotor of a d.c. motor, and preferably of an electronically-commutated (brushless) d.c. motor. Such a motor may be embodied as a switched reluctance motor, but, in a more preferred embodiment, the motor is a permanent magnet brushless motor. Referring to FIG. 13, the hub (2) has an internal cup-shaped member (400) which carries permanent magnets (401,402). The cup shaped member (400), which may be integrally formed with the hub (2), or may be secured thereto, forms the rotor of an electronically commutated motor. The motor further consists of a stator which has core members (410,411), each carrying a respective coil (420,421). The core members (410,411), and hence the coils (420,421) are secured to a base plate (430), which may in turn be secured to a corresponding portion of an associated heat exchanger. The base plate (430) may include the necessary electronic commutating circuitry for switching a direct current supply sequentially to the coils (420,421) to create a rotating magnetic field, thus applying torque to the cup-shaped rotor member (400) for rotating the fan hub (2), and hence the blades (3). The rotating field may be controlled depending on the position of the rotor, to ensure synchronism between the stator and rotor fields.

Figure 14:
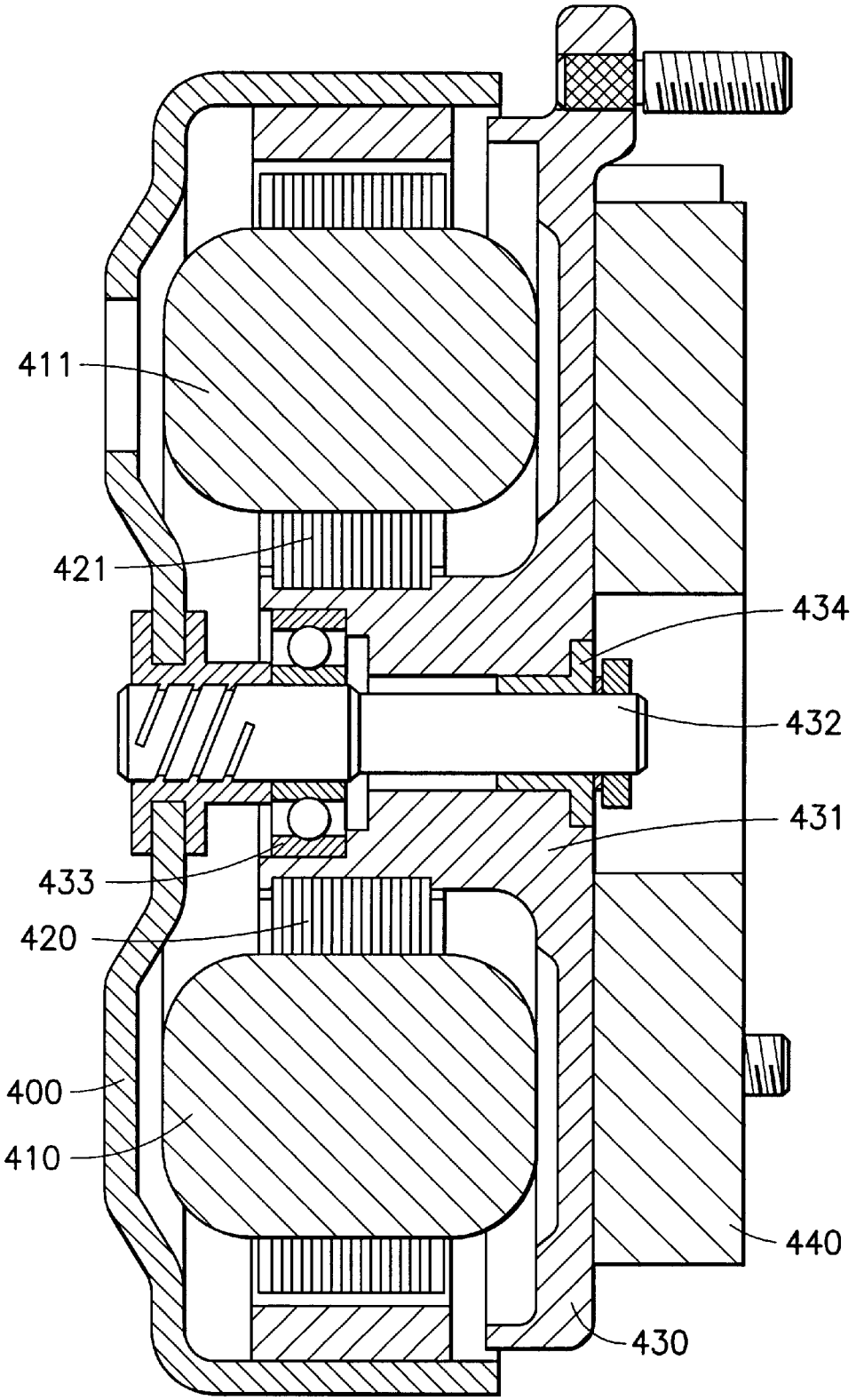
FIG. 14 shows a detailed view of the construction of the motor of FIG. 13.

FIG. 14 shows a more detailed construction of the rotor and stator described above. Referring to FIG. 14, it will be seen that the base plate member (430) has a central boss portion (431) which extends axially of the associated fan, and which supports a shaft member (432) via first and second bearings (433,434). As shown in FIG. 14, the first bearing (433) is a ball bearing and the second bearing (434) is a sleeve bearing. In the arrangement of FIG. 14, the base plate member (430) supports a circuit module (440). Thus, it will be seen that in the arrangement of FIG. 14, where the fan and base plate are mounted to a face portion of a heat exchanger, the circuit module (440) will be on the same side of the heat exchanger as the fan.

Figure 15:
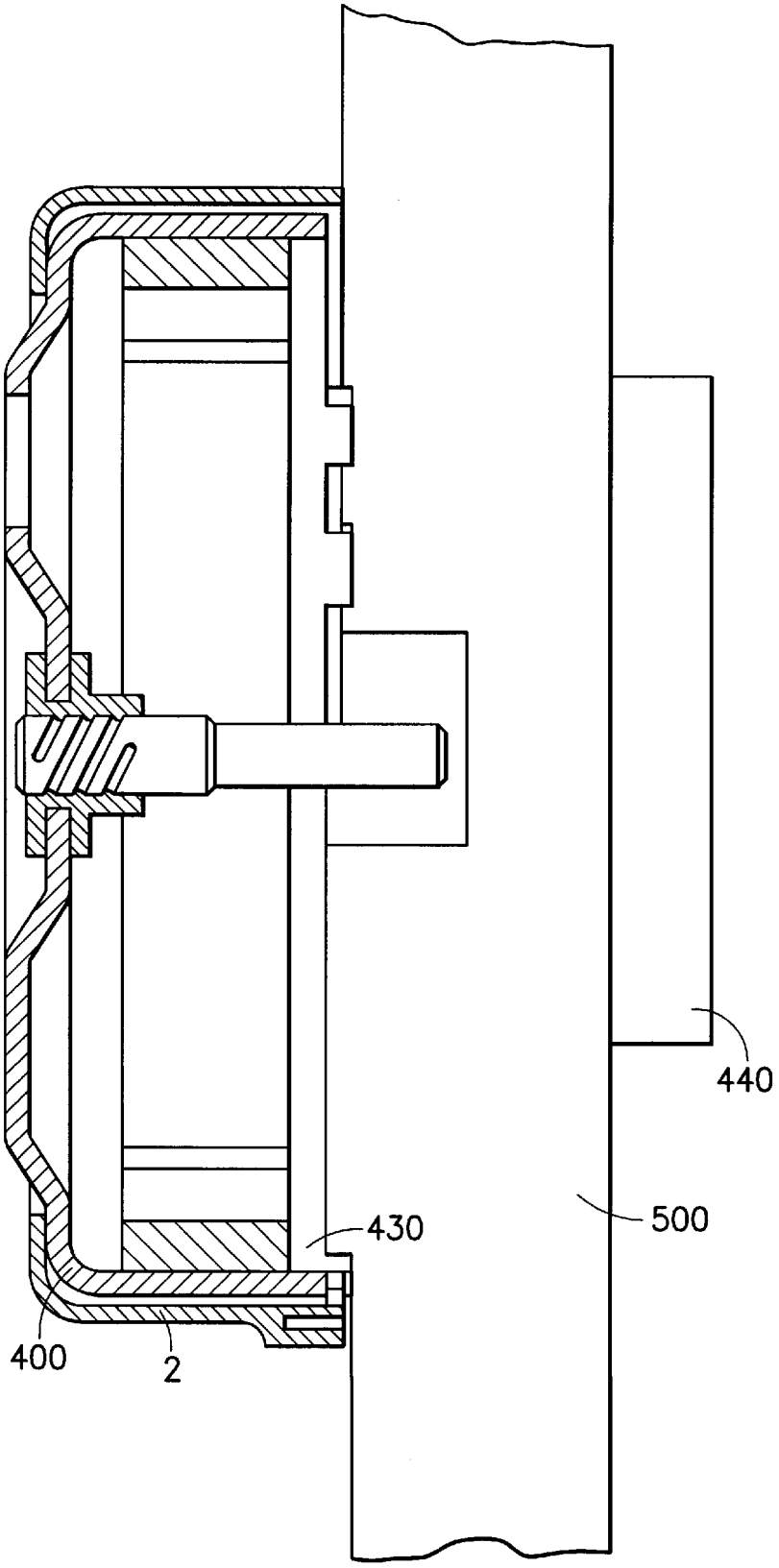
FIG. 15 shows a motor arrangement having remote commutating circuitry.

An alternative arrangement is shown in FIG. 15. Referring to FIG. 15 a heat exchanger (500) supports the base plate (430) on one surface thereof, and on the opposing surface there is disposed the circuit module (440). This arrangement is advantageous in a vehicle application where the heat exchanger (500) is a vehicle radiator, and where the circuit module (440) is better cooled by being disposed on the side of the radiator directed towards an incoming airflow. It will of course be realised that the circuit module could instead be located at a position remote from the radiator, for example secured to the vehicle body work itself. However, this involves complications when mounting the arrangement, since wires must necessarily connect the stator and the circuit module.

The fan according to the invention may also be driven by other means, such as for example by a pneumatic motor, by fluid motor, or by a mechanical drive belt.

Figure 16:
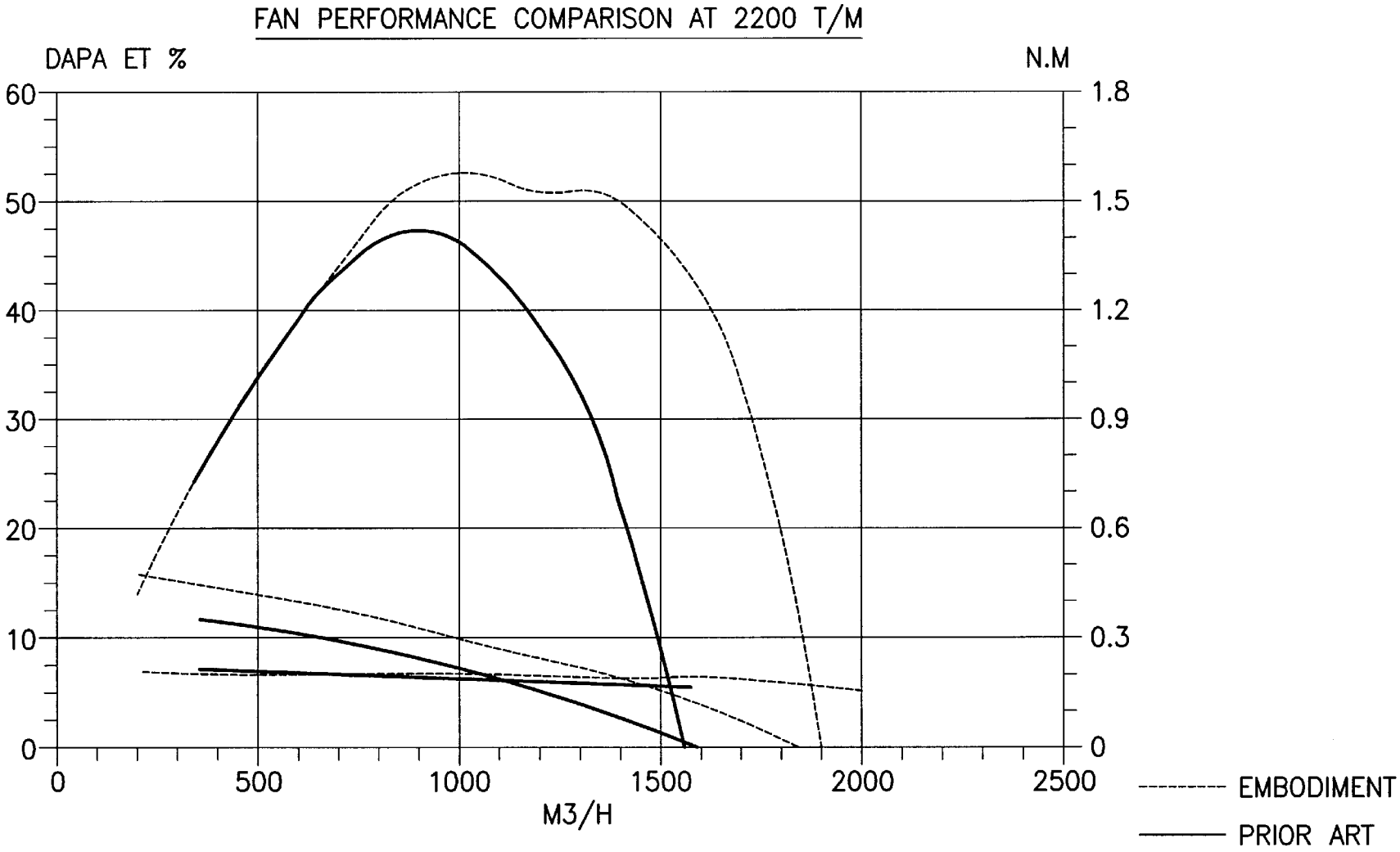
FIG. 16 shows a comparison between the performance of the fan of FIG. 1 and a prior art fan.

FIG. 16 shows a comparative performance graph of the fan of FIG. 1, and a prior art fan. It will be noted that the new fan is more than 10% more efficient that the prior art and that the performance of the fan in terms of air movement is up by between 30% and 40% for the same running conditions.

Figure 17:
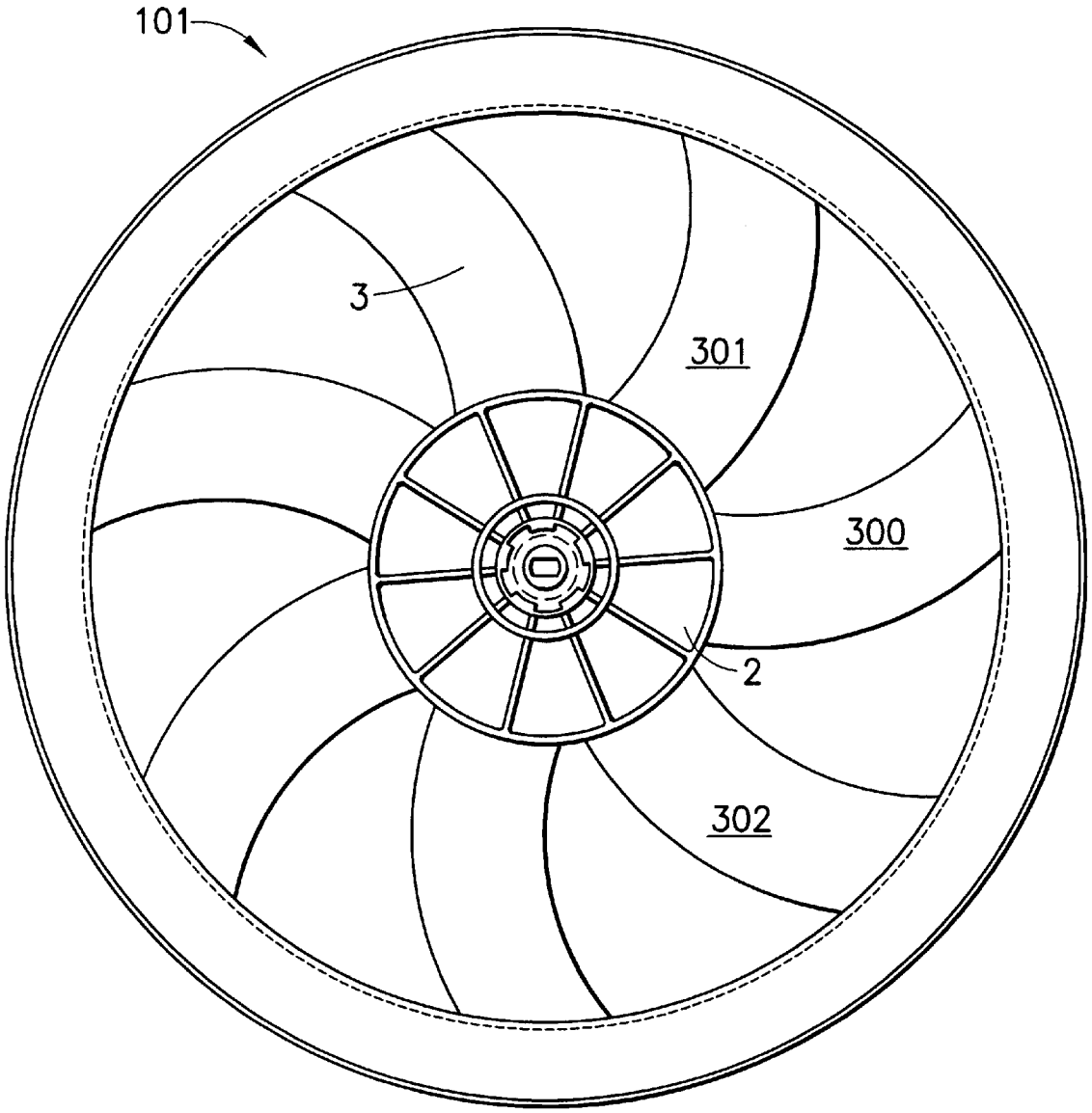
FIG. 17 shows a front elevation of a seven-bladed fan in accordance with the invention.

FIG. 17 shows an alternative fan (101) of the invention. The fan (101) is somewhat similar to fan (1) but has seven blades (3) screwed to a hub portion (2). However, careful inspection of FIG. 17 shows that the blades are not evenly spaced. For example, a first blade (300) is closely spaced to the preceding blade (301) but relatively widely spaced from the succeeding blade (302). This blade arrangement changes the acoustic spectrum of the fan in use. Careful selection of the blade positions allows annoying or disturbing harmonics to be reduced while retaining good air-moving performance. It will be understood that irregularly-spaced blades can be employed with other numbers of blades than seven.

Figure 18:
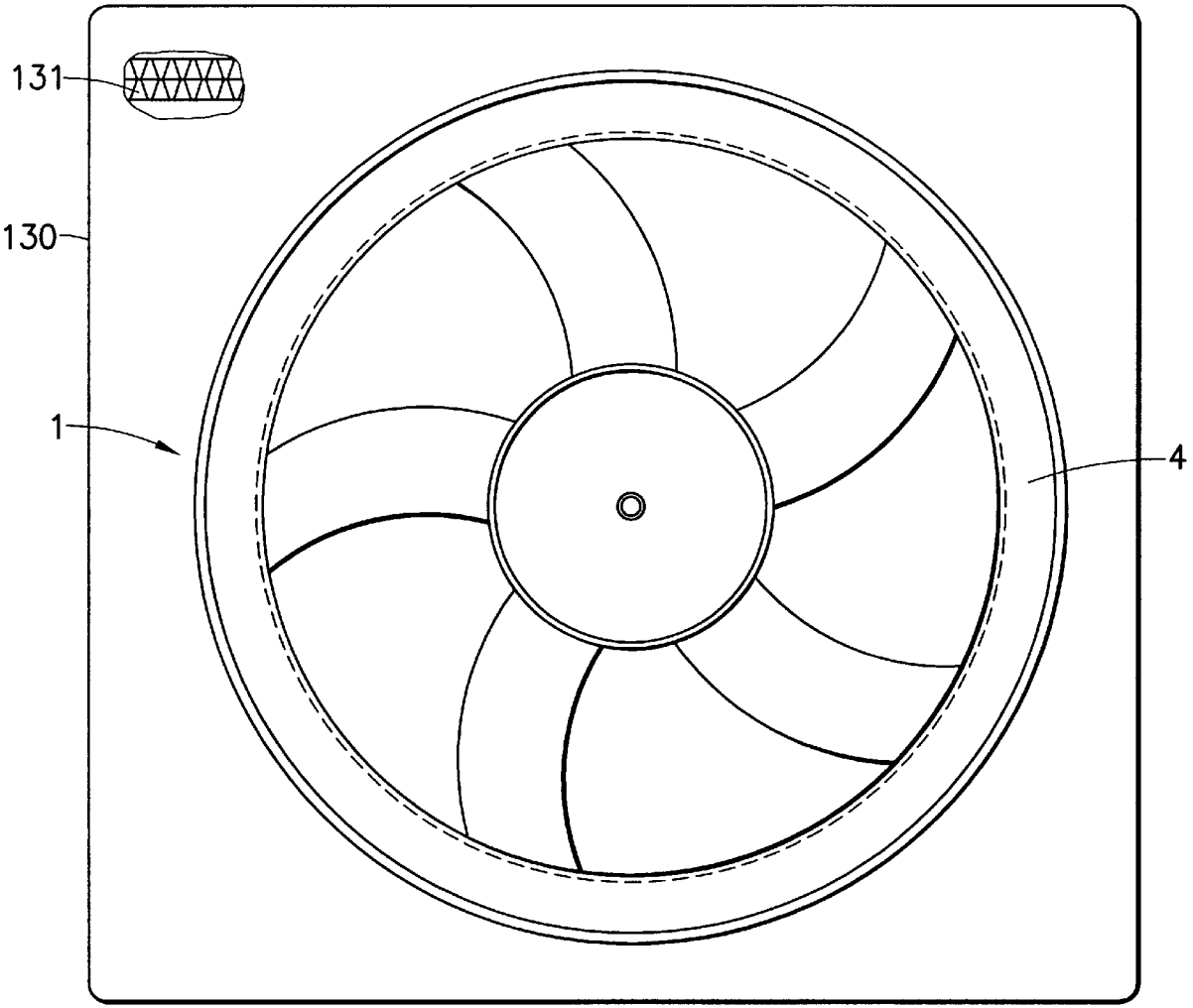
FIG. 18 shows a fan of the invention secured to a vehicle radiator.

Referring now to FIG. 18, one use of a fan of the present invention is shown. As will be seen in FIG. 18, the fan (1) is disposed adjacent to a face portion of a radiator (130). The radiator has a so-called "honeycomb" structure as shown diagramatically by region (131). This honeycomb structure extends substantially across the entire radiator. As will be seen in FIG. 18, the radiator (130) is of a generally rectangular form and, as the fan is circular, this means that substantial peripheral areas of the radiator are not subject to direct action by the fan. However the effect of the rotating shroud or rotary circular members (4) combined with the axial depth of the radiator causes the air flow through the "covered" part of the radiator, in other words the part of the radiator subjected to the fan action, to be in a single direction, as shown out of the page.

In the arrangement described with respect to FIG. 18, the high efficiency of the fan leads to reduced electrical consumption for the same amount of air moved which in turn leads to improved fuel economy for the vehicle. The arrangement is simple and since the fan is secured, via the motor, to the radiator undesired relative movement between the fan and radiator is substantially eliminated.

In an alternative arrangement, not illustrated, the fan of the present invention is also surrounded by a fixed, i.e. non-rotating shroud member which is arranged in close proximity to the rotating shroud (4). In this event, the first opening of the rotating shroud may be disposed remote from the heat exchanger, and within the non-rotating shroud member.

Figure 19:
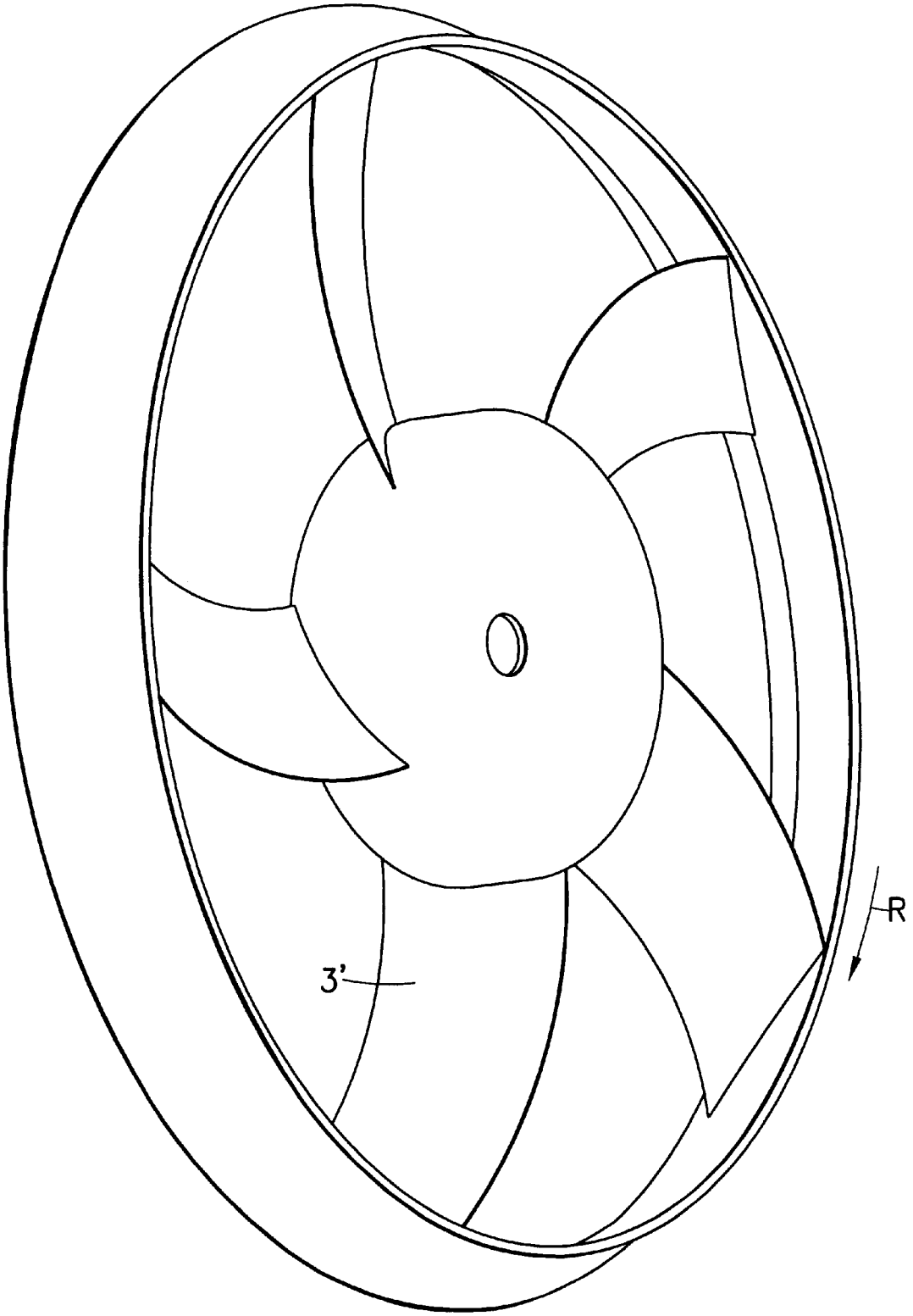
FIG. 19 shows a view similar to that of FIG. 1, of a fan according to the invention, the fan being forwardly skewed.
Figure 20:
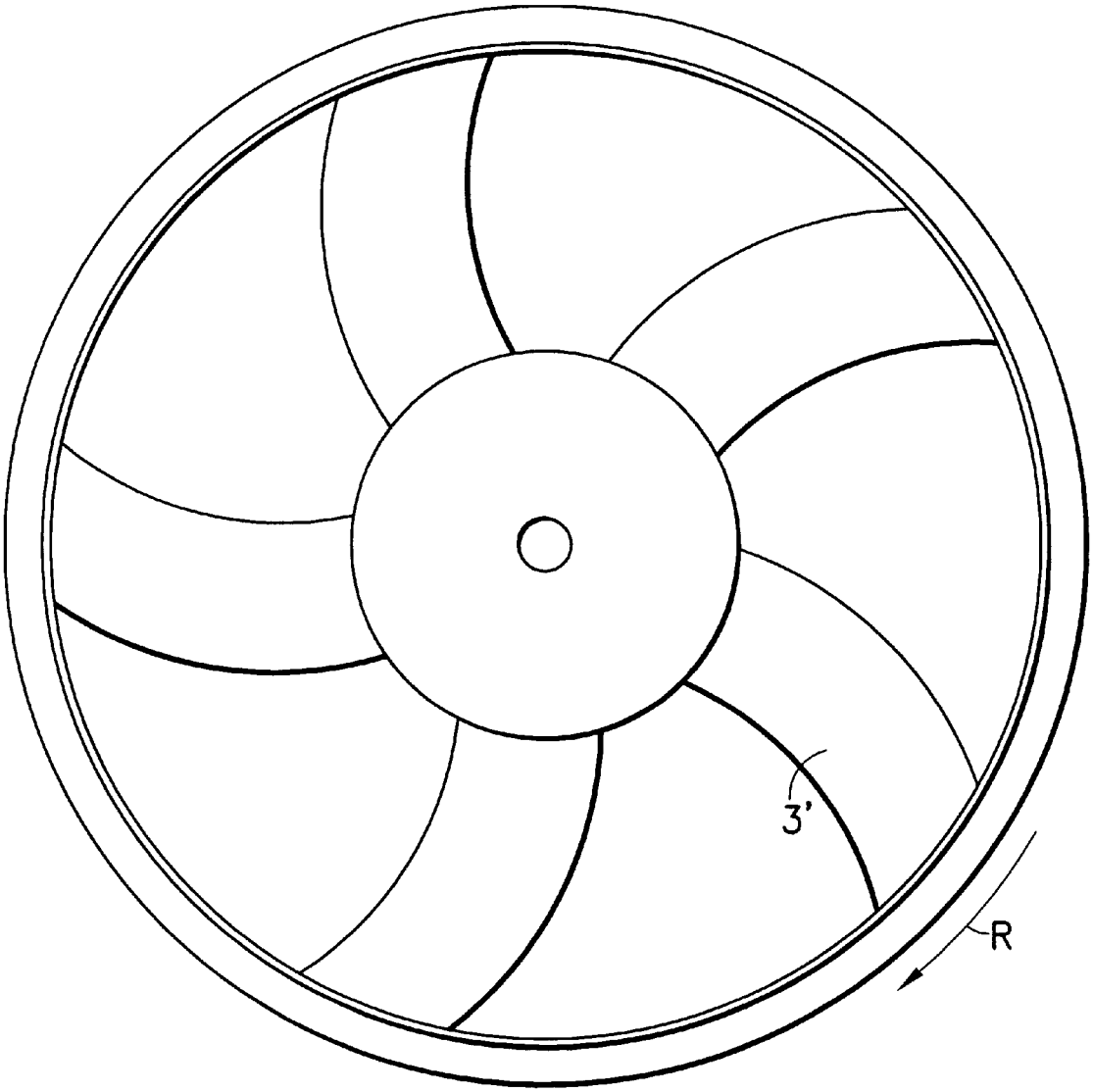
FIG. 20 shows a front elevation of the fan of FIG. 19.

FIGS. 19 and 20 show an embodiment of a fan of the invention in which the blades 3' are forwardly skewed with respect to the direction of rotation of the fan.

Figure 21:
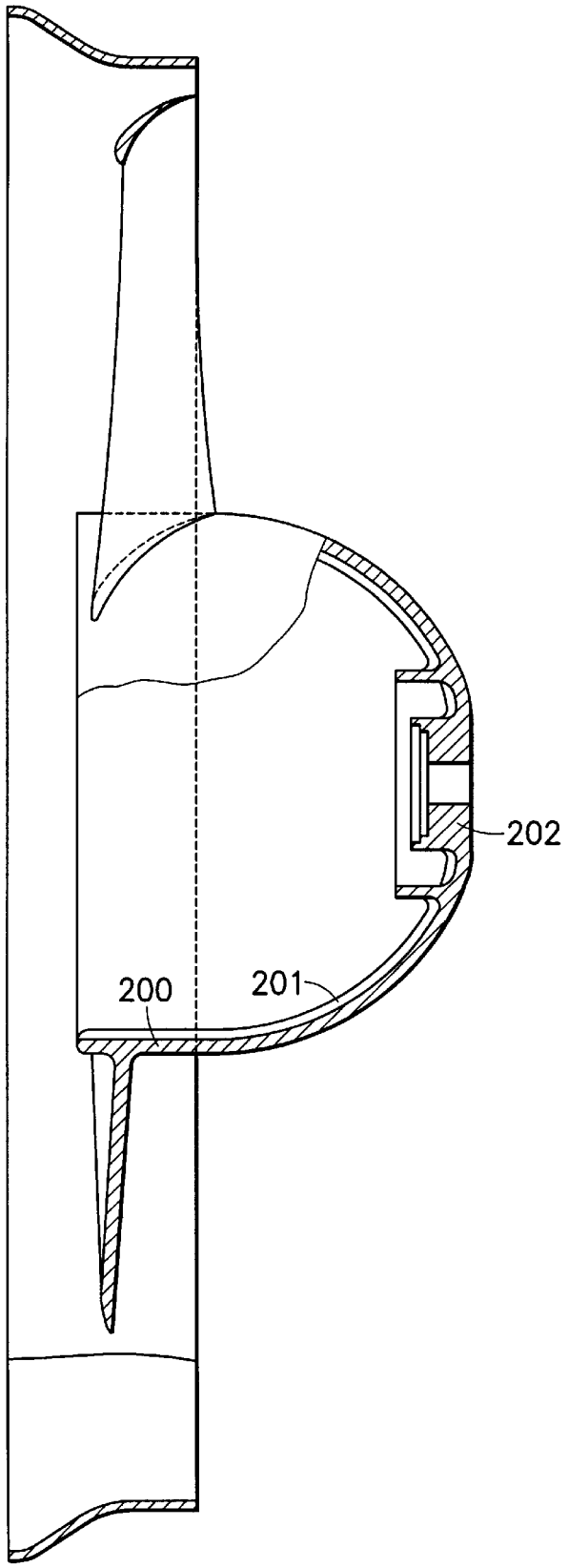
FIG. 21 shows a partial cross-section of a fan of the invention, showing an alternative hub structure.

In FIG. 21 there is shown an alternative hub structure to that previously described with respect to FIG. 3. The hub portion shown in FIG. 21 has a generally cylindrical portion 200, to which the root portions of the blades are secured. However, rather than providing a front face portion to the hub portion which extends immediately from the circular wall portion, the hub portion has a generally hemispherical wall portion 201 curving round from the cylindrical wall portion 200 to a relatively small front face portion 202. In cross section, the hub portion is bowl-shaped. This form has been found to be acoustically advantageous, and especially so where the air flow is directed onto the bowl-shaped face, while at the same time allowing smaller overall dimensions for a fan motor assembly. An electric motor may be disposed substantially within the confines of the alternative hub portion.

It will of course be understood that the fan of the invention may be implemented as a so-called 'pusher' fan, blowing air through an associated heat exchanger, or a so-called 'puller' fan, drawing air through the heat exchanger. Moreover two fans may be disposed side-by-side to provide a greater area of air flow.

I claim:

1. An axial flow fan comprising a hub having a longitudinal axis of rotation and an outer periphery, plural blades secured at their root regions to the hub outer periphery for rotation therewith about the longitudinal axis; each of said blades having a medial line tangential to a respective radius of the hub at the outer periphery thereof and at the blade tip regions, the blades being joined to a member for rotation therewith, the member having a blade tip support portion, the blade tips being secured to the blade tip support portion, and an air guide portion disposed concentrically about the axis beyond the axial extent of the blades, and being contiguous with the blade tip support portion, the air guide portion defining a fan opening lying in a plane perpendicular to the hub axis.

2. An axial flow fan according to claim 1 wherein the blade tip support portion has a first constant radius and the fan opening has a radius greater than said first radius.

3. An axial flow fan according to claim 1 wherein the air guide portion of said member has at least a portion of truncated cone shape.

4. An axial flow fan as claimed in claim 1, wherein there are provided a prime number of fan blades.

5. An axial flow fan as claimed in claim 1, wherein the chord length of each blade is substantially constant from root to tip.

* * * * *